US005635096A

United States Patent [19]

Singer et al.

[11] Patent Number: 5,635,096

[45] Date of Patent: Jun. 3, 1997

[54] VIBRATING RING MOTOR FOR FEEDING PARTICULATE SUBSTANCES

[75] Inventors: Alfred R. E. Singer, Swansea; Dennis H. Sansome, Little Aston, both of United Kingdom

[73] Assignee: Sprayforming Developments Limited of Innovation Center, United Kingdom

[21] Appl. No.: 318,648

[22] PCT Filed: Mar. 29, 1993

[86] PCT No.: PCT/GB93/00637

§ 371 Date: Mar. 6, 1995

§ 102(e) Date: Mar. 6, 1995

[87] PCT Pub. No.: WO93/21353

PCT Pub. Date: Oct. 28, 1993

[30] Foreign Application Priority Data

Apr. 10, 1992 [GB] United Kingdom ..... 9207940

[51] Int. Cl.[6] ..... B22D 41/08

[52] U.S. Cl. ..... 222/603; 222/199

[58] Field of Search ..... 222/603, 199, 222/200; 266/216

[56] References Cited

U.S. PATENT DOCUMENTS 3,941,284 3/1976 McLean ..... 222/199

*Primary Examiner*—Scott Kastler

*Attorney, Agent, or Firm*—David P. Gordon

[57] ABSTRACT

An apparatus for mixing a particulate substance, which may be in chopped or short fibre form, with a matrix metal comprises a container (11) for molten metal (10) having an aperture (12) through which a stream of the metal can fall, a feed motor (20) for feeding the particulate substance into the metal stream, and one or more downwardly inclined nozzles (23) through which jets of atomizing gas are directed on to the combined flow of metal and particulate substance. The feed motor comprising a horizontal ring (20*a*) which extends about and is coaxial with the molten metal stream, and which has a radial vibration imparted to it so as to form a node on the axis of the ring. The upper surface of the ring may be horizontal or may be inclined downwardly towards the axis and may have annular grooves of ratchet tooth section with the steeper part of the section facing towards the axis. The particulate substance is placed on the upper surface of the ring (20) and is caused to move into engagement with the molten metal stream by the radial vibration of the ring.

15 Claims, 2 Drawing Sheets

VIBRATING RING MOTOR FOR FEEDING PARTICULATE SUBSTANCES

BACKGROUND OF THE INVENTION

This invention relates to motors the motor effect of which can be employed in two different ways giving it an important but by no means exclusive application in apparatus for manufacturing metal matrix composite materials, i.e. metals incorporating particulate substances. The term "particulate substances" is used herein to include substances in chopped or short fibre form in addition to powdered and granular substances.

Very fine powders are difficult to make flow in a controlled manner and one means of producing a flow is to cause the material to vibrate. The present invention is based on the discovery that if a ring disposed substantially horizontally is caused to vibrate radially, preferably at its natural frequency, a flowable substance deposited on the upper surface of the ring moves to the central aperture of the ring and further, that material tends during its fall through the ring to move then towards the axis of the ring under the radial compressing force of gas present in the hole and vibrating at the same frequency as the ring.

SUMMARY OF THE INVENTION

According to this invention there is provided a motor comprising a ring arranged with its axis in an up and down direction, and having its upper surface either disposed substantially horizontally or with a downward inclination towards the axis of the ring, and means for imparting radial vibration to the ring so to form a node on the axis of the ring.

Where the motor is used as a feed motor for a particulate substance, means is provided for directing the substance on to the upper surface of the ring.

A hopper for the material may conveniently have its lower end secured to the ring in a manner to vibrate with the ring.

The upper surface of the ring may advantageously be inclined towards the axis of the ring and may be smooth or formed with concentric grooves or a spiral groove of saw-tooth section. In one construction the groove or grooves are of ratchet-tooth section with the steeper face of the section facing towards the axis of the ring.

A useful way of producing metal matrix composites is to atomize the molten matrix metal by gas or other means and introduce into the atomized spray the second phase which can be in the form of solid metallic or non-metallic particles or chopped fibres entrained in a gas stream. The combined stream of metal matrix and second phase particles may then be directed on to a substrate where it solidifies, or may be allowed to solidify as a powder. This procedure has many advantages but is not free from technical problems. One such problem is to achieve some degree of penetration of the metal spray with the gas-entrained second phase to produce a spray in which the second phase is uniformly distributed so as to give a solidified product which has a uniformly distributed second phase. A special difficulty arises when the second phase consists of a very fine powder which may be sub-micron in size. In these circumstances it is difficult to add the particles to the metal stream at a uniform controlled rate with the result that the efficiency of the operation is low.

The invention also provides apparatus for mixing a particulate substance with a matrix metal comprising, for the addition of the particulate substance, a feed motor comprising a ring arranged with its axis in an up and down direction, and having its upper surface either disposed substantially horizontally or with a downward inclination towards the axis of the ring, means for imparting radial vibration to the ring so to form a node on the axis of the ring and means for depositing the substance on to the upper surface of the ring, for directing a stream of the metal in molten form axially downward through the ring, and means for directing one or more downwardly inclined jets of atomizing gas on to the combined flow of molten metal and particulate material.

A process may thus be obtained in which a stream of liquid, which may be coherent or particulate, is passed through a ring, the top surface of which may be sloping inwards and the inner surface of which is not necessarily parallel, containing in the central aperture of the ring a gas which the ring is radially resonating at high frequency, and in which a particulate solid is passed on to the top surface of the vibrating ring such that both the particulate solid and the stream of liquid are forced by the vibration of the ring and the vibration of the gas enclosed in the central aperture towards a central nodal position in the ring where they are brought together and may or may not intermingle, the combined streams then being atomized either by gas or other means, to form a spray in which the component parts are uniformly distributed. Such a spray may be directed onto a surface where it solidifies to form a spray deposit or may be allowed to solidify in flight to form a particulate material or may be collected as a liquid containing a dispersion of solid particles.

The process is applicable to any metal that can be melted and atomized into a stream of liquid particles. Moreover, any powder or chopped fibre can be used provided the powders or chopped fibre will pass easily into the central aperture of the ring.

A particular feature of the process is that the powder or chopped fibre is forced by the radial vibration of the ring to move from the hopper towards the central aperture. This forced movement can be intensified by machining rings or spirals on the top surface of the resonator.

In an application of the invention to an apparatus to carry out this process the second phase particles and the metal stream are moved to a central nodal position on passage through a ring that is vibrating in an ultrasonic mode. The rapidly vibrating ring has two motor effects. Firstly it causes the particulate solid to move across the top face of the vibrating ring towards a central position. The movement can be accentuated by providing a downward slope on the top face of the ring. Secondly the vibrating ring causes the gas within the ring to vibrate correspondingly such that a node is formed in the gas at a central axial position. Any streams of liquid or particulate solid are moved towards this node on passage through the ring. In the case of a metal matrix composite being made from a powder which may be a ceramic or oxide and a stream of liquid metal, the powder is moved rapidly towards the liquid metal stream across the top face of the ring and is forced into contact with the liquid metal stream which itself is moved to a central position, if not already there, and extended axially. The movement of both the powder and the liquid metal into a central nodal position as they pass through the ring enables the subsequent atomizing to give a uniform distribution of the second phase in the spray and ultimately in the solidified spray deposit.

The ring should vibrate at or close to its natural resonant frequency to maximise the displacement amplitude. The shape and dimensions of the ring should be such as to optimise the radial motion and to avoid fatigue failure but, within this constraint, it is possible to contour both the external and any internal surfaces to minimise the risk of fatigue and the dissipation of vibrational energy. Stainless steel has been found to be a satisfactory material from which to make the ring.

The frequency of vibration is preferably selected to satisfy several criteria. Relatively low frequencies such as 50–5000 Hz give rise to unacceptable design constraints and to distressing audible disturbance which at high powers can be a serious health hazard. Above 18 kHz the vibration ceases to be audible to most humans. The range of 18–25 kHz usually avoids discomfort or aural damage. Higher frequencies can be used but for a given power input the displacement amplitude is correspondingly reduced, the beneficial effect with regard to the invention is reduced and the power effectiveness is lower. Furthermore there may again be an unacceptable engineering design constraint in that the radially resonant ring may have too small a diameter to be useful.

The invention will now be described in more detail with reference by way of example to the accompanying diagrammatic drawings.

DETAILED DESCRIPTION OF THE PREFERRED EMBODIMENTS

Figure 1:
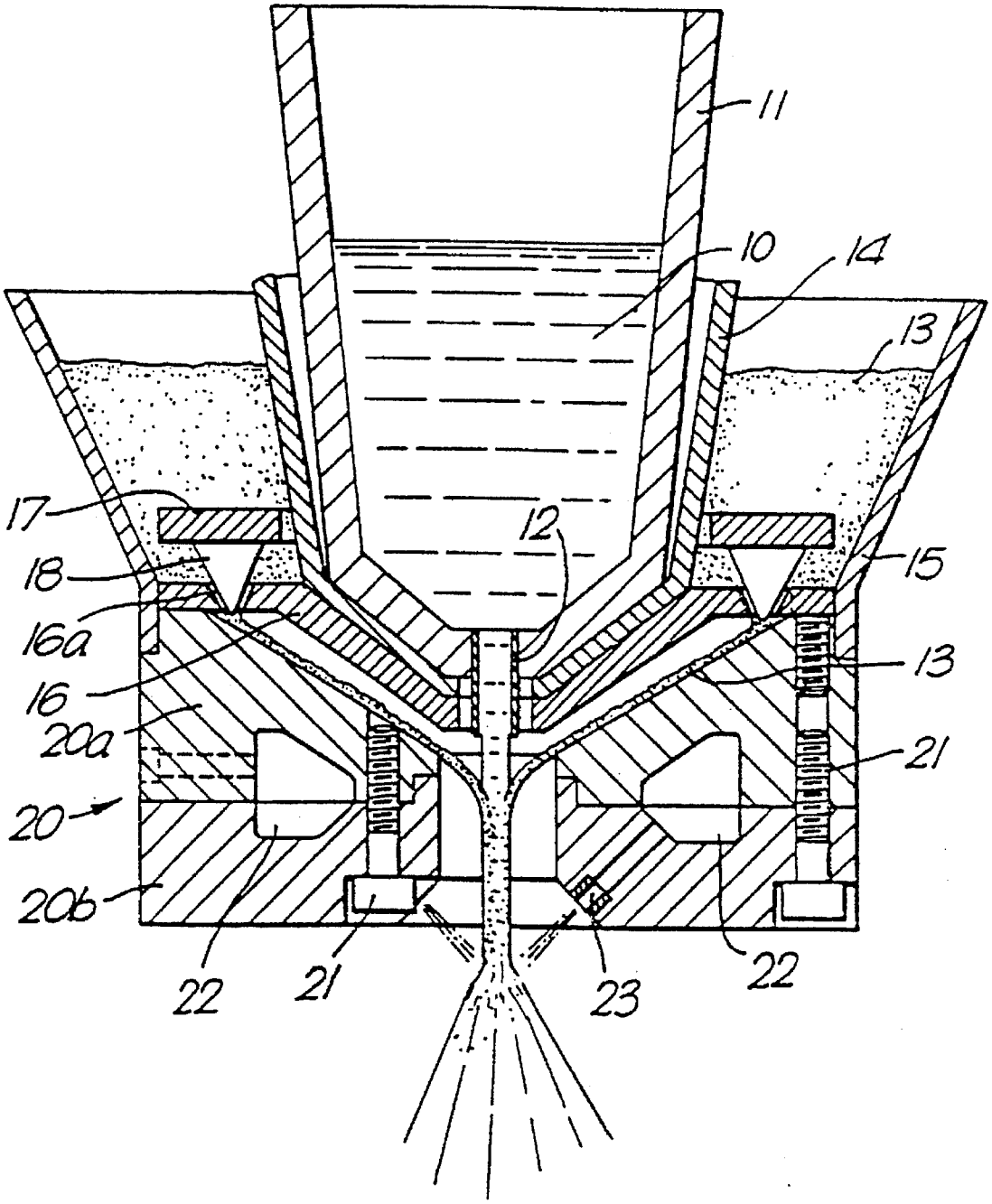
FIG. 1 shows an axial section a first embodiment of the invention as applied in an apparatus for mixing a particulate substance with a matrix metal.

Referring to FIG. 1, the matrix molten metal 10, e.g. aluminium alloy, is contained in a tun-dish 11 at the bottom of which is a pouring nozzle 12 for the metal. The particulate material, which in this instance may be silicon carbide in the form of 10 um powder 13, is contained in an annular hopper comprising an inner wall 14 encircling the tun-dish 11, an outer wall 15 and a bottom wall 16. A series of valve apertures 16*a* are formed in the bottom wall 16, and an annular plate 17 carrying valve elements 18 engaged in the valve apertures can be raised and lowered to control the outlet area of the hopper. The side wall 15 of the hopper is secured to the upper end of a stainless steel ring 20 comprising upper and lower parts 20*a*, 20*b* secured together by bolts 21. An annular plenum chamber 22 is formed in the parts 20*a*, 20*b* jointly and gas under pressure, which may be a gas to which the metal is inert such as nitrogen or argon, is supplied to the chamber and from the chamber is supplied to a ring of nozzles 23 mounted in the ring 20 and inclined downward towards the axis of the ring 20. The ring 20 is caused by means not shown to vibrate at 20 kHz by way of concentrators and transducers from a 3 kw ultrasonic generator, and the ring 20 is so designed that it resonates at the selected vibration frequency.

In operation of the apparatus, the outer wall of the hopper vibrates with the ring 20 and causes the powder to flow through the valve apertures 16*a* on to the upper surface of the ring. The radial vibration of the ring causes the powder to move radially inward along the upper surface of the ring and into the central aperture at the same time as the matrix metal 10 flows downwardly through the aperture. A flow of the inert gas above the powder on the upper surface of the ring is caused to vibrate radially when it enters the central aperture of the ring and the powder is impelled by the vibration into close contact with the stream of metal and in some cases partially to penetrate the metal stream as it accelerates in a downward direction and attenuates. The combined stream of particles and molten metal is atomized by the jets of gas issuing from the nozzles 23 to give a spray having a uniform distribution of powder particles. The combined stream may be directed onto a cool substrate to form a deposit of a metal matrix composite having a uniform dispersion of the silicon carbide powder in the aluminium alloy.

It will be understood that any metal or alloy can be used as the matrix and any powder or powder mixture or short or chopped fibre can be used as the added phase.

The resonating ring 20 centralises the metal stream and prevents or reduces sideways break-up. This is a very useful characteristic since small deviations in the metal stream can cause major changes in behaviour on atomization.

Provision may be made for cooling of the resonating ring 20 by a suitable coolant flowing through passages formed in the ring.

The mechanism of the centralising movement within the central aperture is related to the pattern of vibration of the gas. The molecules of gas in the central aperture are set in vibration and produce a node at a central position. Any solid or liquid within this aperture is forced towards the node, the driving force diminishing as the nodal position approached. This causes constriction of a stream of liquid metal and of any suspended particles. The constriction causes a stream of liquid metal to become smaller in diameter and elongate usually in a downward direction assisted by gravity; the constriction also has the effect of driving particles into the attenuating liquid stream. The effect occurs with particles having a very wide range of sizes including sub-micron particles. This application of the invention is particularly useful with sub-micron particles because their handling and propulsion by conventional means from a hopper towards the liquid metal stream is difficult if they are not agglomerated into granules.

The velocity of gas within the central aperture of the vibrating ring 20 is not important unless the velocity is high. High velocities cause particles to be propelled so rapidly through the central orifice that there is too little time for the centralising forces to operate effectively. Lower gas velocities, however, may be very useful to maintain the entrainment of small particles and also to prevent blow-back during atomization.

A further important point of note is that the upper surface of the ring need not be inclined downward towards the axis but may be horizontal since the motor effect driving particulate material radially inward is still obtained. Also the ring is not necessarily circular and the cross-section of the ring may be shaped either for concentrating the vibrational effect at the central part or to conform with external requirements or for a compromise between the two. In all cases it is however necessary, for energy efficient operation, to ensure that the applied frequency coincides with the current resonant frequency of the ring.

In the modified construction shown in FIG. 2, the ring 20 is formed in one piece, and the gas nozzles 23 are formed in a separate hollow ring member 24 disposed just below and concentrically with the ring. As in the previous construction the gas jets incline downwardly and towards the axis of the ring. This construction has the advantage that the ring is easier to manufacture than the two-part ring and that the ring is easier to tune to the required frequency and resonates more effectively. It also reduces the likelihood of fatigue failure of the ring but has the disadvantage of lengthening the free-fall of the metal and powder before atomization takes place.

Figure 2:
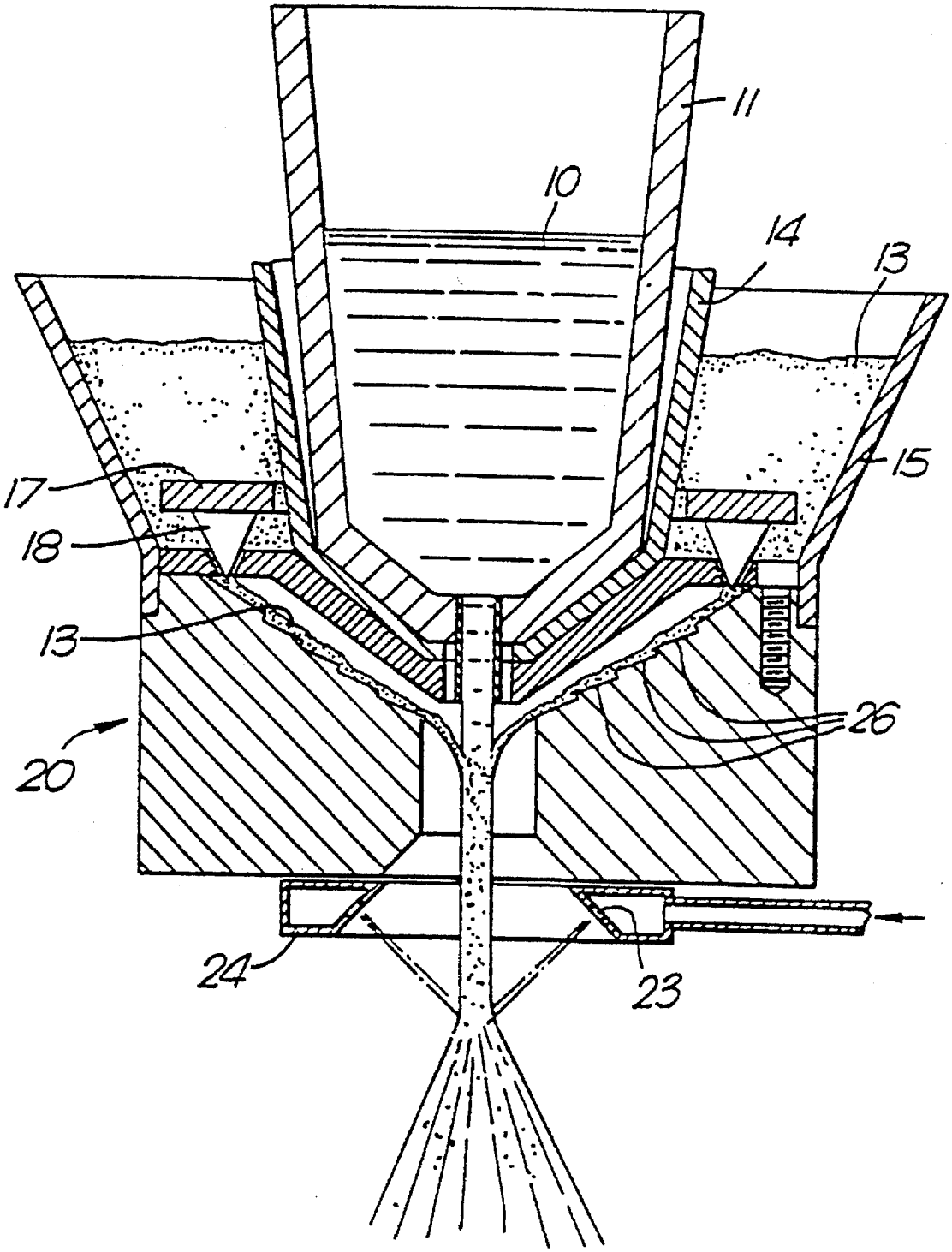
FIG. 2 is a view similar to FIG. 1 of a modified form of the apparatus.

Also in the arrangement of FIG. 2, the upper surface of the ring is formed with a series of concentric grooves of somewhat saw-tooth form, or preferably of ratchet-tooth form with the steeper face of the tooth facing towards the axis of the ring. A helical groove of similar section may be provided instead of the concentric grooves if desired. The grooves drive the powder more effectively towards the central aperture because the surfaces vibrate in a horizontal mode. Any vertical component of the vibration has the supplementary effect of causing fluidization of the powder flowing across the upper surface of the ring and promotes uniform distribution of the particles.

In another application of the invention, the feed motor constituted by the radially vibrating ring may be employed to produce a uniform flow of fine powder from a hopper through the central aperture of the ring. In such embodiments, the cuter wall of the hopper is secured to the ring at or near the periphery of the ring. Fine powders which do not readily flow are caused by the vibration of the ring and the hopper to be deposited on the upper surface of the ring and to flow towards the central aperture in a steady stream. When vibration is stopped the flow of powder stops almost instantly. Such an apparatus may operate in conjunction with a weight sensing device to fill containers with a predetermined weight of powder. If the powder has a higher degree of flowability the hopper may be provided with a valve to control the flow of the powder onto the upper surface of the ring.

In another application of the feed motor, the ring is employed in conjunction with a tun-dish 11 of molten metal 10 arranged to flow in a stream downward coaxially through the centre of the ring. Provision is made also for a flow of air or other gas through the centre of the ring about the flow of molten metal. When the ring is caused to vibrate at resonant frequency the radial vibration of the gas stream about the molten metal within the central aperture of the ring centralizes the flow of molten metal and prevents or reduces sideways break-up of the metal stream. As previously described, this is advantageous where the stream of molten metal is to be atomized to produce either a powder or a spray-formed product.

The radial vibration of the ring is accomplished through a transducer system in a manner known per se and will not be described here. The amount of vibrational energy required is an important factor because the radially inward driving force is proportional to the amplitude of vibrations which is, in most cases, proportional to the energy input, so that a degree of control of the rate of flow can be obtained by adjusting the power input and hence the amplitude of the vibrations. It has been found in practice that in most cases it is necessary to have an input of at least 1 kW. For dealing with large quantities of materials, energies between 3 and 10 kW may be necessary. The amount of energy required also depends on the design of the resonator. A well designed resonator will resonate with a minimum dissipation of energy whereas a poorly designed, or poorly matched one, will be inefficient. For continuous operation it may be necessary to cool the ring to avoid a rise in temperature that would change the acoustic properties.

Either external or internal cooling may be used but in the case of internal cooling the cooling channels needed either for gas or water cooling must be designed to minimise the deleterious effects on the acoustic performance of the ring.

The equipment need not be used in a completely vertical attitude because the centralising effect operates irrespective of gravity and this can be a useful way of deflecting the stream of metal through a small desired angle. Gravitational effects will, of course, cause deviation of the metal stream and asymmetry of distribution of the particles which is not desirable in most cases.

We claim:

1. A feed motor for a particulate substance, comprising:

a) a ring arranged with a substantially vertical axis and having an upper surface which is oriented in one of a substantially horizontal and a declining inward orientation;

b) vibrating means for imparting radial vibration to said ring so to form a node on said vertical axis of said ring; and c) directing means for directing the particulate substance onto said upper surface of said ring.

2. A motor according to claim 1, wherein:

said ring and said means for imparting radial vibration to said ring are adapted to vibrate said ring at its natural resonant frequency.

3. A motor according to claim 1, wherein:

said ring is stainless steel.

4. A motor according to claim 1, wherein:

said upper surface of said ring is declined towards said axis of said ring and is formed with one of a series of coaxial grooves and a spiral groove.

5. A motor according to claim 4, wherein:

said one of a series of coaxial grooves and a spiral groove is of saw-tooth section.

6. A motor according to claim 4, wherein:

said one of a series of coaxial grooves and a spiral groove is of ratchet-tooth section with the steeper face of the section facing towards said axis of said ring.

7. A motor according to claim 1, wherein:

said means for directing the substance on to said upper surface of said ring comprises a hopper, said hopper having a lower end secured to said ring in a manner to receive the vibration of said ring.

8. A motor according to claim 7, wherein:

said lower end of said hopper is secured to an outer edge of said ring.

9. A motor according to claim 7, further comprising:

d) valve means for controlling the flow of material from said hopper onto said upper surface of said ring.

10. An apparatus for mixing a particulate substance with a matrix metal, said apparatus comprising:

a) a feed motor for a particulate substance, said feed motor having i) a ring arranged with a substantially vertical axis and having an upper surface which is oriented in one of a substantially horizontal and a declining inward orientation, ii) vibrating means for imparting radial vibration to said ring so to form a node on said vertical axis of said ring, and iii) particulate directing means for directing the particulate substance on to said upper surface of said ring;

b) stream directing means for directing a stream of the matrix metal in molten form axially downward through the ring; and c) jet directing means for directing at least one downwardly inclined jet of atomizing gas onto the combined flow of molten metal and particulate material.

11. An apparatus according to claim 10, wherein:

said jet directing means is a ring of nozzles included in said ring.

12. An apparatus according to claim 1, wherein:

said ring further includes an annular plenum chamber to which atomizing gas under pressure is supplied and which is in communication with said ring of nozzles.

13. An apparatus according to claim 10, wherein:

said jet directing means is an annular member provided with a ring of nozzles disposed closely below and coaxially with said ring.

14. An apparatus according to claim 10, wherein:

said ring is provided with passages for a flow of a coolant fluid.

15. A method of feeding a particulate substance to a selected location utilizing a ring having a central axis, an upper surface, and a resonant frequency, said method comprising:

a) disposing the ring with its axis arranged vertically and in position over the location, and arranging the upper surface of said ring in one of a substantially horizontal orientation and a declining orientation towards the axis of the ring;

b) depositing the substance on the upper surface; and c) imparting radial vibration to the ring at the resonant frequency of the ring, wherein a node is formed on the axis of the ring.

* * * * *